US005106484A

United States Patent [19]

Nadler et al.

[11] Patent Number: 5,106,484

[45] Date of Patent: Apr. 21, 1992

[54] PURIFYING FEED FOR REFORMING OVER ZEOLITE CATALYSTS

[75] Inventors: Murray Nadler, Houston, Tex.; John F. Walsh, Baton Rouge, La.; David S. Brown, Houston, Tex.

[73] Assignee: Exxon Chemical Patents Inc., Linden, N.J.

[21] Appl. No.: 629,879

[22] Filed: Dec. 19, 1990

[51] Int. Cl.[5] ..... C10G 35/06; C10G 25/00; C07C 7/12; C07C 7/00

[52] U.S. Cl. ..... 208/91; 208/138; 208/188; 208/208 R; 208/248; 208/299; 208/301; 208/302; 208/303; 585/820; 585/836; 585/850; 585/852; 585/853

[58] Field of Search ..... 585/820, 822, 836, 850, 585/852, 853; 208/91, 138, 188, 208 R, 248, 303, 299, 301, 302

[56] References Cited

U.S. PATENT DOCUMENTS

| | | | |
|---|---|---|---|
| 2,951,804 | 9/1960 | Juliard | 208/91 |
| 4,028,223 | 6/1977 | Hayes et al. | 208/91 |
| 4,225,417 | 9/1980 | Nelson | 208/91 |
| 4,575,415 | 3/1986 | Novak et al. | 208/91 |
| 4,588,496 | 5/1986 | Scherzer | 208/120 |
| 4,592,829 | 6/1986 | Elserly, Jr. | 208/91 |
| 4,634,515 | 1/1987 | Bailey et al. | 208/91 |
| 4,634,518 | 1/1987 | Buss et al. | 208/138 |
| 4,795,545 | 1/1989 | Schmidt | 585/822 |
| 4,980,046 | 12/1990 | Zarchy et al. | 208/99 |

*Primary Examiner*—Anthony McFarlane
*Assistant Examiner*—Nhat Phan
*Attorney, Agent, or Firm*—Edward F. Sherer

[57] ABSTRACT

The present invention is directed to a process for treating hydrotreated naphtha which involves treating the naphtha over massive nickel catalyst followed by treating the naphtha over a metal oxide under conditions effective for removing impurities from said naphtha to result in substantially purified naphtha, wherein the metal oxide is selected from the group of metal oxides having a free energy of formation of sulfide which exceeds said free energy of formation of platinum sulfide, such as manganous oxide. In so doing, naphtha in the gas phase in the presence of hydrogen is passed over the manganous oxide at a temperature within the range of about 800° F. and 1100° F., a hydrogen to oil molar ratio between about 1:1 and 6:1, a whsv between about 2 and 8, and pressure between about 50 and 300 psig; and the naphtha in the liquid phase at a temperature between about 300° F. and about 350° F., and whsv less than about 5 is passed over the massive nickel.

The naphtha in the liquid phase, at about ambient temperature, and at a whsv between 2 and 10, may also be passed over a Na Y mole sieve prior to treating over massive nickel and manganous oxide. In addition the naphtha be being passed over alumina after treating over massive nickel and prior to treating over manganous oxided in the liquid phase, at a temperature between 300° F. and 350° F., and a whsv between 2 and 10.

The naphtha may also be passed over a mole sieve water trap in the liquid phase at ambient temperature and at a whsv between 2 and 10, prior to treating over massive nickel and manganous oxide.

23 Claims, 1 Drawing Sheet

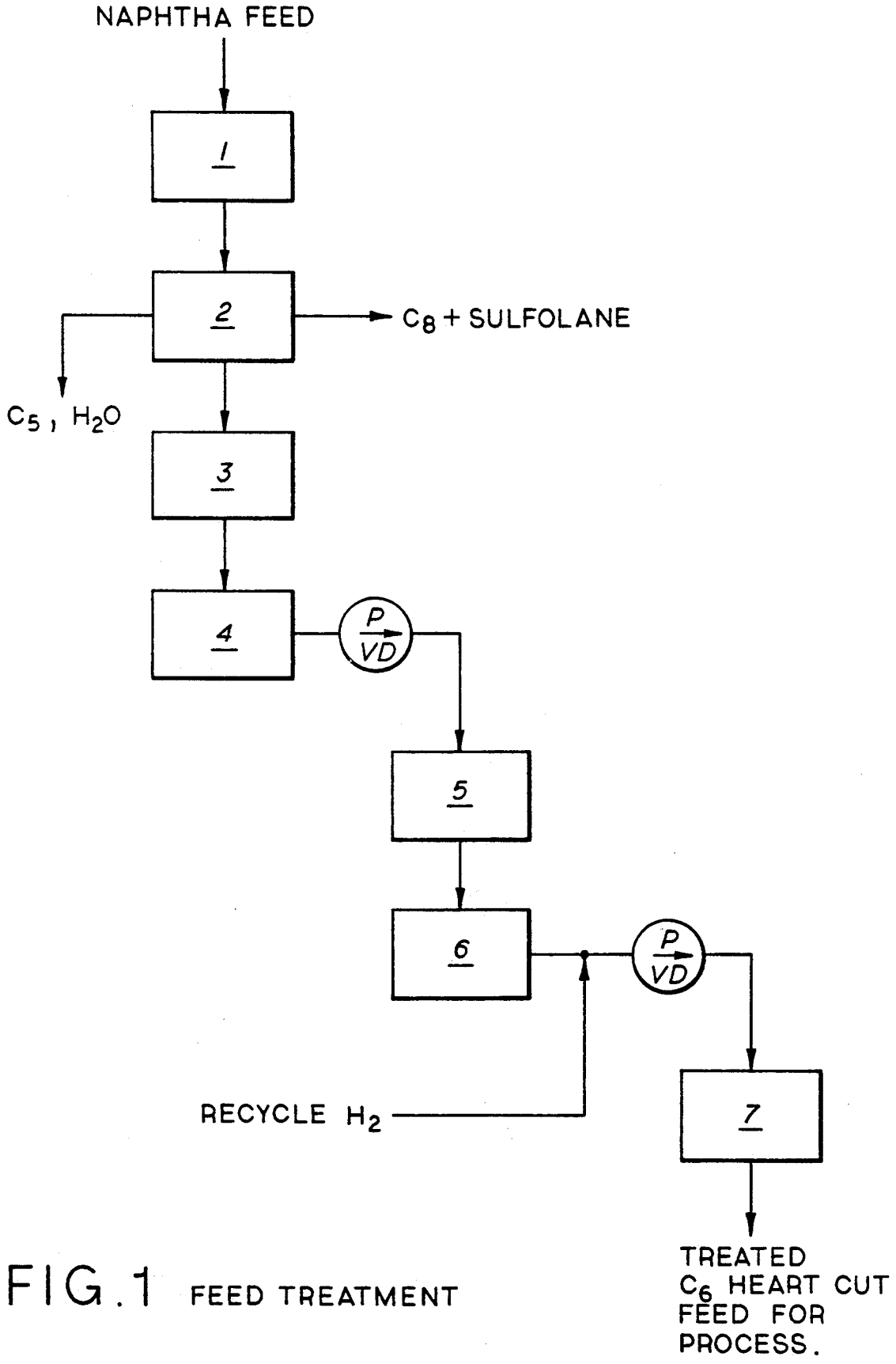
FIG. 1 FEED TREATMENT

PURIFYING FEED FOR REFORMING OVER ZEOLITE CATALYSTS

BACKGROUND OF THE INVENTION

1. Field of the Invention

This invention relates to purifying hydrocarbons, such as naphtha. More particularly, the present invention is directed to a process for purifying naphtha to be used for reforming over zeolite based catalysts.

2. Discussion of Background and Material Information

Catalytic reforming is a well known petroleum refining process for increasing the octane rating of naphtha, i.e., $C_5$ to $C_{11}$ hydrocarbons, for blending into motor gasoline, and for converting paraffins and naphthenes to light aromatics which are extracted and sold as petrochemical raw material.

The principal chemical reactions which occur in reforming are dehydrogenation of cyclohexane to aromatics, dehydrocyclization of paraffins to aromatics, dehydroisomerization of alkylcyclopentanes to paraffins, isomerization of normal paraffins to branched paraffins, and dealkylation of alkylbenzenes. Reforming catalysts also crack part of the naphtha to light hydrocarbon fuel gas. Cracking is undesirable because light hydrocarbons have a low value.

Typically, reforming is performed at temperatures between about 800° F. and 1000° F., pressures of about 50 psi to 300 psi, hourly weight space velocities of about 0.5 to 3.0 in the presence of hydrogen at hydrogen to oil molar ratios of one to ten.

Commercial reforming units typically comprise three or four packed bed reactors in series. Both axial and radial reactors are used and these can be either stationary or moving beds. The reactors are adiabatic and because reforming is a net endothermic process, the temperature drops between the inlet and outlet of each reactor. Accordingly, reactor effluents are reheated in furnaces between stages. The product stream from the last reactor is cooled and flashed to low pressure in a drum and separated into a reformate liquid stream rich in aromatics and a gas stream rich in hydrogen. Part of the gas stream is recycled into the feed stream to provide the hydrogen required for the process. Reforming reactions produce net hydrogen which is recovered from the gas stream leaving the flash drum.

Reforming catalysts progressively deactivate due to coke deposition, agglomeration of catalytic metals, and poisoning by trace impurities in feedstock. Sulfur is a particularly virulent poison to reforming catalysts. Periodically, reforming is stopped and the catalyst is regenerated by burning the coke, redispersing the catalytic metals by converting them to mobile chloride species, and reducing the dispersed metals. However, sulfur, once on the catalyst is difficult to remove by regeneration procedures.

Modern commercial reforming catalysts are bifunctional, i.e., they have two types of catalytic sites: metal sites and strong acid sites, both supported on alumina base. The catalytic metal sites contain a Group VIII metal, commonly platinum, finely dispersed on the alumina substrate. Typically, a second catalytic metals such as rhenium or iridium is also used. The acid sites are formed by chemisorbing chloride on the alumina catalyst base. Dehydrogenation and cyclization reactions occur on the metal sites and isomerization reactions on the strong acid sites. Cracking occurs on the acid sites. Bifunctional catalysts aromatize $C_8$+ paraffins effectively but are less effective for $C_6$ to $C_8$ paraffins; more of the light paraffins are cracked to fuel gas then are converted to light aromatics.

Recently, reforming catalysts have been discovered which have significantly higher activity and selectivity for aromatizing $C_6$, $C_7$ and $C_8$ paraffins than bifunctional catalysts. They differ significantly from bifunctional catalysts both in composition and in their reforming mechanism. The substrate for these novel catalysts is a large pore zeolite rather than alumina. Large pore zeolites are defined as zeolites with pore diameters of between 6 to 15 Angstroms. Common large pore zeolites include zeolites X,Y,and L. Zeolite based catalysts are monofunctional, i.e., both isomerization reactions and dehydrocyclization reactions occur on the metal catalytic sites; the acid functionality is not involved, or kept to a minimum. In fact stringent measures are taken during manufacture of zeolite reforming catalysts to minimize acid sites since acid sites promote undesirable cracking reactions. The remarkable facility of these zeolite based catalysts for aromatizing light paraffins at high activity, selectivity, their resistance to coking, and activity maintenance stability, are attributed to steric effects in zeolite pores where the chemical reactions occur and absence of acidity.

Of the large pore zeolites, zeolite L is preferred for reforming catalysts. Zeolite L is described in U.S. Pat. No. 3,216,789 which is hereby incorporated in its entirety by reference thereto herein. Synthesis of a form of zeolite L which is particularly advantageous for reforming catalysts is disclosed in U.S. Pat. No. 4,544,539, the disclosure of which is also incorporated in its entirety by reference thereto herein. This advantageous form of zeolite L is comprised of at least 50% near cylindrical crystals with aspect ratio of at least 0.5 and mean diameter of at least 0.5 microns. Zeolite L is crystallized using potassium cations to balance electronegativity in the zeolite structure. Potassium ions can be ion exchanged with other cations using standard techniques. Potassium is a suitable exchangeable cation for reforming catalysts. Also, reforming catalysts with barium replacing some of the potassium cations have been reported.

Zeolite L powder is recovered as a fine powder. The powder is formed into aggregate particles, typically extrudates 1/32" to ⅛" in size, to be suitable for use in commercial packed bed reactors. An inert binder such as alumina or silica is used to impart strength to the formed catalyst without inducing unwanted chemical activity. Techniques for extruding zeolite L reforming catalysts are discussed in commonly owned, copending U.S. patent application Ser. No. 07/414,285 filed Sept. 30, 1989 entitled "Extruded Zeolite Catalysts".

Catalytic metal salts are impregnated or ion exchanged into the formed zeolite substrate particles to complete catalyst preparation. At least one Group VIII metal is included in the catalyst formulation. The preferred Group VIII metal is platinum. Typical platinum loadings range from 0.3 to 1.5 wt. %. U.S. Pat. No. 4,568,656 teaches a preferred method for ion exchanging platinum into zeolite L. U.S. Pat. Nos. 4,595,668, 4,595,669, and 4,595,670 disclose preferred reforming catalysts comprising platinum on potassium zeolite L in which 90% of the platinum is dispersed as particles less than 7 Angstroms, the disclosure of which are hereby incorporated in their entirety by reference herein thereto.

Large pore zeolite reforming catalysts, as described above, are significantly more sensitive to trace impurities in feed than bifunctional alumina based reforming catalysts. Trace impurities harmful to zeolite reforming catalysts include nitrogen compounds, oxygenated compounds, diolefins, water, and particularly, sulfur compounds. We have determined that sulfur accumulation on catalyst approaching about one atom of sulfur per ten atoms catalytic metal significantly impairs the activity, selectivity and activity maintenance, and, therefore, the commercial viability of the catalyst. Moreover, once on the catalyst, sulfur is difficult to remove. The extreme sulfur sensitivity of large pore zeolite based reforming catalysts is discussed in U.S. Pat. No. 4,456,527 which teaches reducing feed to large pore zeolite based reforming catalysts to below 100 ppb and preferably to below 50 ppb.

Naphthas which are used for reforming typically contain between 50 wppm to 500 wppm sulfur as mercaptans, such as butyl mercaptan, thiophene, hindered thiophenes, such as 2,5-dimethylthiophene, and thiols, such as 2-propanethiol. Naphthas also contain olefins and traces of compounds containing nitrogen and oxygen. Also, raffinate from aromatics extraction units, which are a desireable feedstock for zeolite reforming processes, derived from extraction processes which use sulfolane as the extraction solvent may from time to time contain traces of sulfolane. Accordingly, naphthas for reforming are usually treated with hydrogen over a hydrotreating catalyst, such as sulfided cobalt and molybdenum on alumina support or nickel and molybdenum on an alumina support, to protect reforming catalysts.

Hydrotreating converts sulfur compounds to hydrogen sulfide, decomposes nitrogen and oxygen compounds, and saturates olefins. Hydrotreating is done at a temperature between about 400° F. and 900° F., a pressure between 200 psig and 750 psig, liquid hourly space velocity between one and five, and hydrogen circulation rate of 500 to 3000 scf/b. Hydrotreater effluent is fractionated in a distillation tower into a light overhead stream which carries off most of the hydrogen sulfide, water and volatile nitrogen compounds formed during hydrotreating, a heartcut stream which is the feed for the zeolite reformer, and a heavy bottoms stream. The preferred heartcut for zeolite reformer feed contains $C_6$ to $C_8$ hydrocarbons. $C_8$+ hydrocarbons accelerate deactivation of zeolite reforming catalysts. The preferred light cutpoint sends dimethylbutanes, overhead out of the reformer feed heartcut. Dimethylbutanes (DMB) are the most volatile of the C6 paraffins; they do not aromatize over zeolite catalysts, but instead crack to gas. Inasmuch as DMB's have relatively high octane ratings, they are blended into motor gasoline. The bottoms cutpoint controls $C_7$ hydrocarbons and $C_8$ hydrocarbons in the heartcut.

Modern hydrotreating processes can reduce sulfur concentration in naphtha to 0.25 wppm and even to 0.1 wppm. This is acceptable for conventional bifunctional alumina based reforming catalysts. Even so, several reformer feed treatment improvements have been developed to further reduce sulfur in hydrotreated naphtha. These treatments have been reported to marginally improve reformer bifunctional alumina based acidic catalyst performance.

One of these reformer feed treatments, disclosed in U.S. Pat. No. 3,898,153, is passing hydrotreated reformer feedstock together with recycle hydrogen required for reforming through a zinc oxide bed. The zinc oxide bed is preceded by a chloride scavenging zone which is necessary because zinc oxide will react with traces of HCL in the recycle hydrogen stream to form zinc chloride. Zinc chloride is volatile and will be carried off by the reformer feed stream and enter the reactor where it will poison the reforming catalyst.

Another reformer feed treatment, disclosed in U.S. Pat. No. 4,634,518, is passing hydrotreated reformer feed over massive nickel catalyst. Massive nickel catalyst is 20 wt. % to 75 wt. % finely dispersed metallic nickel, i.e., particles having a size with the range of about 75 to 500 Angstrom, supported on alumina, or silica. Suitable commercial grades of massive nickel include Harshaw's D-4130, UCI's C28-1-01, and Huls's H 10125 rs which are sold as 132" extrudates. Typical operating conditions for massive nickel treating are within the range of about 300° F. and 400° F., 5 whsv and 10 whsv, and a feed rate between about 100 lb/hr naphtha per square foot and 200 lb/hr naphtha per square foot of massive nickel bed.

Still another treatment for purifying hydrotreated feedstock for reforming, disclosed in U.S. Pat. Nos. 4,320,220, 4,225,417, 4,575,415, and 4,534,943, is treatment over manganese oxides. Manganese oxides are sufficiently resistant to attack by traces of HCl that an upstream chloride scavenging zone is not required. Manganese oxides are typically sold as extrudates or pellets formed with an inert oxide support, such as alumina or silica. One suitable manganese oxide formulation is Sulfur Guard HRD-264 sold by Englehard. Recommended treatment conditions are temperatures within the range of about 600° F. to 1000° F., pressures within the range of about, 150 psig to 700 psig, 1/1 to 30/1 hydrogen to oil molar ratio, and 500 to 50,000 ghsv.

These reformer feedstock treatments, i.e., hydrotreating followed by zinc oxide, massive nickel or manganous oxide, are directed to preparing feed for bifunctional alumina based reforming catalysts. However, these reformer feedstock treatments have been discovered not to be adequate for zeolite based reforming catalysts because zeolite based catalyst are significantly more sensitive to trace feed impurities, particularly sulfur.

U.S. Pat. No. 4 456 527 suggests processes for purifying hydrotreated feed for reforming over zeolite L catalyst. They include: a) passing the feed over a suitable metal or metal oxide, for example copper, on a suitable support, such as alumina or clay, at low temperatures in the range of about 200° F. to 400° F. in the absence of hydrogen; b) passing a hydrocarbon feed, in the presence or absence of hydrogen, over suitable support at medium temperatures in the range of 400° F. to 800° F.; c) passing a hydrocarbon feed over a first reforming catalyst, followed by passing the effluent over a suitable metal or metal oxide on a suitable support at high temperatures in the range of 800° F. to 1000° F.; d) passing a hydrocarbon feed over a suitable metal or metal oxide and a Group VIII metal on a suitable support at high temperatures in the range of 800° F. to 1000° F.; and e) any combination of the above. These processes in their most preferable modes are reported to reduce sulfur in reformer feedstock to less than 50 ppb. This degree of sulfur removal is still too high for zeolite catalyst feedstocks.

Engelhard, in their literature for HRD-264 (TI-802), recommends a form of manganese oxide sold under the trademark Sulfur Guard for treatment of reformer feedstocks to improve performance of gas phase reforming catalysts.

Although treating reformer feedstocks over massive nickel and over manganese oxides are both known, these procedures have not been combined in series in accordance with the present invention. Moreover, prior to the present invention it is not believed that reforming feedstock has been treated over massive nickel followed by manganese oxide prior to reforming over a large pore zeolite based mono-functional, non-acidic reforming catalysts in accordance with the present invention. Controlling the process to preclude accumulating one mole sulfur to ten moles platinum averaged across the lead reactor in the reformer train is also believed to be novel.

SUMMARY OF INVENTION

In general, the present invention relates to a process for purifying naphtha feedstock for reforming over large pore zeolite based monofunctional, non- acidic reforming catalysts.

The present invention is directed to a process for treating hydrotreated naphtha to be used in such a reforming process by first treating naphtha over massive nickel catalyst; followed by treating the naphtha over a metal oxide under conditions effective for removing impurities from the naphtha to result in purified naphtha.

More specifically, process of the present invention involves passing the feedstock in liquid phase first over massive nickel catalyst followed by passing the feedstock in vapor phase over a metal oxide with strong affinity for sulfur.

Metals whose oxides have free energy of formation (absolute value) higher than platinum have been discovered to be effective for purposes of the present invention. These include cobalt, lead, iron, zinc, manganese, molybdenum, barium and calcium. Manganese is preferred. For purposes of the present invention, the metal oxides are selected from the group of metal oxides having a free energy of formation of sulfide which exceeds said free energy of formation of platinum sulfide, wherein the metal oxide is preferably manganous oxide.

In accordance with the present invention, the naphtha in the gas phase in the presence of hydrogen is passed over manganous oxide, wherein the conditions for treating the naphtha over said manganese oxide comprise a temperature within the range of about 800° F. and 1100° F.; a hydrogen to oil molar ratio between about 1:1 and 6:1; a whsv between about 2 and 8, and pressure between about 50 and 300 psig; the naphtha is passed over massive nickel in the liquid phase at a temperature between about 300° F. and about 350° F., and whsv less than about 5.

In accordance with the present invention, the process also involves feeding the substantially purified naphtha over a reforming catalyst comprising a large pore zeolite and at least one Group VIII metal, preferably wherein the reforming catalyst is monofunctional and non-acidic.

For purposes of the present invention the large pore zeolite is zeolite L, the Group VIII metal is platinum, and the reforming catalyst is in the form of an aggregate, which preferably comprises an inert metal oxide binder.

In accordance with the present invention, naphtha is also treated over a Na Y mole sieve which involves passing naphtha in the liquid phase, at about ambient temperature, and at a whsv between 2 and 10, over the Na Y mole sieve prior to treating over massive nickel and manganous oxide.

In accordance with the present invention, naphtha is also treated over activated alumina, which involves passing said naphtha in the liquid phase, at a temperature between 300° F. and 350° F., and a whsv between 2 and 10, over the alumina after treating over massive nickel and prior to treating over manganous oxide.

In accordance with the present invention, naphtha is also treated over a mole sieve water trap wherein treating the naphtha over the mole sieve water trap is accomplished in the liquid phase at ambient temperature and at a whsv between 2 and 10, prior to treating over massive nickel and manganous oxide, preferably wherein the mole sieve water trap is a 4A mole sieve, and most preferably wherein treating naphtha over a mole sieve water trap is the first step in the purification process.

Most preferably, the present invention is directed to a process for treating hydrotreated naphtha feedstock which involves the sequence of the following steps: treating naphtha over a water trap; treating naphtha over a Na Y mole sieve; treating naphtha over massive nickel; treating naphtha over alumina; and treating naphtha over a metal oxide in the presence of hydrogen to result in a purified naphtha stream, after which the substantially purified naphtha stream is passed through a reforming catalyst at reforming conditions, wherein the reforming catalyst comprises a large pore, non-acidic zeolite and at least one Group VIII metal, preferably wherein the large pore zeolite is zeolite L, and the at least one Group VIII metal is platinum, and wherein the reforming catalyst in the lead reactor absorbs less than about one mole of sulfur per 10 moles of platinum in a first stage lead reactor per 10,000 hours when the treated naphtha is passed through the reforming catalyst at reforming conditions and at a whsv between four and eight.

Relating to the foregoing, the process of the present invention treats the feed using a water trap, such as a molecular sieve, to remove traces of water; over NaY molecular sieve to remove sulfolane; and over alumina to remove traces of nitrogen, oxygen, olefins, and other polar impurities which can impair catalyst performance.

The purification process in accordance with the present invention is also performed under conditions which minimize or substantially prevent sulfur from accumulating in the reforming reactor in excess of one mole of sulfur per 10 moles of platinum in the reactor in 10,000 hours of reforming the treated feed at reforming conditions when feed whsv is in the range of 4 to 8.

BRIEF DESCRIPTION OF THE DRAWING

The attached Figure is a flow chart of the process of the present invention.

DETAILED DESCRIPTION OF INVENTION

The present invention is directed to purifying hydrocarbon streams and is particularly suitable for treating hydrocarbon feedstocks for reforming over a large pore zeolite based catalysts. Preferred feedstocks include $C_6$ to $C_8$ cuts from virgin naphthas and aromatics extraction raffinate.

For purposes of the present invention the feedstocks to be purified are preferably hydrotreated using a conventional process and catalyst to produce a hydrotreated reformer feedstock which is also referred to herein as reformer feedstock. After hydrotreating, the reformer feedstock contains typically 0.1 to 0.2 wppm sulfur, 150 ppm water, traces of oxygen, nitrogen, and olefin compounds; a trace of sulfolane may also be present.

In accordance with the present invention, hydrotreated reformer feedstock, in liquid phase, is passed through a fixed bed of mole sieve selected to remove traces of water, such as 4A mole sieve. Preferred operating conditions are ambient temperature, about 250 psig pressure, and 2 to 10 weight hourly space velocity, although these treatment parameters may be varied so long as acceptable results are obtained. Water concentration is reduced to below about 1 wppm.

If the reformer feedstock contains raffinate from a sulfolane aromatics extraction unit, it is next passed, in the liquid phase, through a fixed packed bed of NaY mole sieve to remove entrained sulfolane. In accordance with the present invention, it has been established that NaY is uniquely effective for removing traces of sulfolane from naphtha. Preferred operating conditions are ambient temperature, about 250 psig pressure, and about 2 whsv to about 10 whsv. However, these treatment parameters may be varied so long as acceptable results are obtained.

The reformer feedstock, also referred to in as reformer heartcut, still in the liquid phase, is next passed through a packed bed of massive nickel catalyst to remove sulfur. Operating conditions which are preferred for maximum sulfur removal include about 300° F. to about 350° F., and about 2 to about 5 whsv. In accordance with the present invention, it has been discovered that sulfur removal falls off precipitously outside these condition ranges. This treatment has been discovered to reduce sulfur concentration to at least below about 30 ppb, which is the lowest resolution achievable with the Houston Atlas sulfur analyzer which is the state-of-art instrument for measuring sulfur in hydrocarbons. The reformer feedstock, still in the liquid phase, is next passed over a bed of activated alumina to remove traces of polar impurities, including nitrogen, oxygen, and olefin compounds, which may impair catalyst activity. Kaiser Activated Alumina A-202 is a satisfactory alumina for this purpose. The alumina treatment is performed at 300° F. to 350° F. and 2 to 10 WHSV, although these treatment parameters may be varied so long as acceptable results are achieved.

The last step in the feed treatment process of the present invention is passing feed through a bed containing manganese oxides. Sulfur bonds tightly to manganese, more tightly than to platinum. The manganese oxide preferred for purposes of the present invention is sold commercially by Engelhard Corporation, Specialty Chemicals Division, as Sulfur Guard, a manganese oxide/alumina extrudate (HRD-264). The manganese oxide alumina extrudate (HRD-2644), also referred to herein as Sulfur Guard, used for purposes of the present invention has the following properties:

| | |
|---|---|
| Crush Resistance, Min. (Lbs. per 1/8" pellet) | 5 |

-continued

| | |
|---|---|
| Loading Density, lb/ft$^3$ | 7 |
| Pellet Size: | |
| Diameter, inches | 0.10 |
| Length, inches | 0.25 |

The HRD-264 catalyst has been described as follows:

| Ingredients | | |
|---|---|---|
| Chemical Identity | OSHA PEL | ACGIH TLV |
| Alumina | | |
| Respirable Dust | 5 mg/m$^3$ | 5 mg/m$^3$ |
| Total Dust | 15 mg/m$^3$ | 10 mg/m$^3$ |
| Manganese Oxide (as Manganese Mn) | 5 mg/m$^3$ (c) | 5 mg/m$^3$ (c) |
| Physical/Chemical Characteristics | | |
| Melting Point | | 995° F. |

In accordance with the present invention, the bonding affinity of manganese for sulfur is known to increase with increasing temperature so it is desireable to perform the manganese feed treatment where the feed stream is at a maximum temperature substantially immediately upstream of the lead reforming reactor. At this point in the process the feedstock has been vaporized by cross heat exchange with the reformer reactor product stream in large heat exchangers, and preheated in a furnace to between 800° F. and 1050° F. The manganous oxide treatment can be done before or after the recycle hydrogen that is required for reforming is mixed into the feedstock. Manganous oxide decompose mercaptans, hydrogen sulfide, and unhindered thiophenes quantitatively but hindered thiophenes, such as methyl or dimethyl thiophene which are present in refinery naphtha in small quantities to a lesser degree. It is preferred to treat hydrocarbon streams over manganous oxide in the presence of recycle hydrogen because hydrogen promotes decomposition of hindered thiophenes. Also, passing the recycle hydrogen stream over manganous oxide affords an extra degree of protection for the reforming catalyst should sulfur be released from equipment in the recycle gas loop into recycle hydrogen.

Recycle hydrogen contains traces of HCl derived from platinum salts used to formulate the catalyst and from residues of chemicals used to regenerate the catalyst. Although not wishing to be bound by any particular theory, it is believed that HCl reacts with manganese oxides to form manganese chlorides which are volatile and could be carried into the reactor in the feed stream. Metal chlorides are known to poison reforming catalysts. However, in pilot plant tests of this process, no deleterious effects on catalyst have been observed from which it is concluded that manganese oxides are sufficiently resistant to trace amounts of HCl to preclude poisoning the catalyst. However, facilities are provided to isolate the manganese oxide during regeneration to avoid exposing manganese oxides to regeneration gas streams, which contain high chloride concentrations.

Preferred conditions for treating naphtha over manganous oxide include temperatures with the range of about 800° F. and 1100° F., pressures within the range of about 50 to about 300 psig, hydrogen to oil molar ratio between about 1:1 and about 6:1, and about 2 to about 8 whsv, although these parameters may be varied so long as acceptable results are obtained.

Referring to the Figure, a $C_5$ to $C_{11}$ naphtha, hydrofined in hydofiner 1, is distilled in fractionation towers 2 to distill out a mixed $C_6$ heartcut comprising paraffins, naphthenes, and aromatics. The $C_6$ heartcut stream, contains about 100 ppb sulfur, about 150 ppm water and a trace, i.e., less than about 1 ppm sulfolane. The $C_6$ heartcut stream is then passed through a 4A mole sieve 3 at ambient temperature and about 250 psig at about 10 whsv. This treatment reduces water content in the naphtha cut to below about 1 ppm. The substantially dry stream is next passed through a bed of Na Y zeolite 4 at ambient temperature and about 250 psig at about 10 whsv. This treatment removes the trace of sulfolane. The substantially sulfolane-free stream is next heated to about 350° F. and passed over a bed of massive nickel 5 at about 250 psig and about 4 whsv which reduces sulfur content in the naphtha to less than about 30 ppb. The stream having a reduced sulfur content is next passed over a bed of alumina 6 at about 350° F. and about 250 psig at about 5 whsv to remove other impurities. The resultant stream is then mixed with hydrogen to the specified reformer hydrogen to oil ratio heated to about 1000° F., vaporized, and passed through a bed of manganese oxide 7 at about 174 psig and about 20 whsv to remove remaining sulfur. The treated naphtha hydrogen stream mixture is then passed to the first stage reactor of a zeolite L reformer.

EXAMPLES

The following are given as non-limiting examples of the present invention.

Example 1

The feed treatment process of this invention was used to purify naphtha fed to a reformer reactor using an extruded alumina bound platinum on potassium zeolite L catalyst. The naphtha was received substantially sulfur-free, but it was intentionally adulterated with a mixture of sulfur compounds typical of those found in refinery naphtha to a concentration of 100 ppb sulfur. Sulfur concentration in naphtha at the outlet of the massive nickel absorber was measured periodically during the experiment and sulfur on the reforming catalyst was measured before and after the experiment. In addition, conversion and selectivity of naphtha to paraffins was continually monitored for indication that catalyst activity was falling prematurely, which would be indication that sulfur poisoning was occurring. Sulfur concentration in the massive nickel absorber effluent was below the 30 ppb detectable level for the entire run. Also measurement of sulfur in the catalyst before and after the run made by x-ray fluorescence analysis showed no sulfur was deposited on the catalyst during the run. Moreover, there was no premature rapid reduction of catalyst activity indicating that the catalyst was not deactivating prematurely. These results would indicate that the feed treatment process of the present invention is advantageous for preparing naphtha for reforming over zeolite catalysts.

Details of the experiment follow:

a) Feed

The feed (in weight percent) comprised 40% $iC_6$, 38% $nC_6$, 16% naphthenes, and 6% other hydrocarbons. The adulterating sulfur mixture comprised 80%, 2-propanethiol; 18%, thiophene; and 2,5 dimethylthiophene. Feed sulfur content was 0.1 ppm.

b) Water removal

The feed in liquid state was treated over molecular sieve 4A at ambient.

c) Sulfur removal

The feed in liquid state was next treated over UCI-T2451 massive nickel at 350° F. and 4.0 whsv. The effluent was essentially devoid of sulfur using the Houston Atlas sulfur measurement procedure. The lower detectable limit of the analysis is about 0.01 ppm sulfur.

d) Trace impurities removal

The feed in liquid state was next treated over alumina at 350° F. and 8.0 whsv.

e) Trace sulfur removal

The feed in vapor state was mixed with recycle hydrogen from the reactor flash drum in 4:1 molar ratio and treated over Englehard's manganese oxide Sulfur Guard brand adsorbent at 806° F. and 140 psig.

f) Catalyst

The reforming catalyst was 1/16" extruded potassium zeolite L bound with 28% alumina and containing 0.64 wt % platinum.

g) Reforming

The reforming reactor was a 1" id tube immersed in a sandbath maintained at 950° F. WHSV was 1.74 and hydrogen to oil molar ratio was 4.0. Run length was 1200 hours. Total pressure was 140 psig. Benzene yield was 20% to 25% during the 1200 hour run and selectivity was 70%.

g) Conclusions

There was no premature deactivation or selectivity decline which would indicate that the catalyst was being sulfur poisoned during the run. Also, the sulfur content of the fresh catalyst and catalyst at the reactor inlet, halfway down the reactor and near the outlet at the end of the run were determined by X-ray fluorescence. The sulfur contents of all samples were close to the 30 wppm lower resolution limit of the analytical technique. Therefore, the catalyst did not accumulate sulfur during the run indicating that the purification process of this invention is very effective. It is particularly noteworthy that catalyst near the reactor inlet where sulfur accumulation would be most noticeable did not exhibit sulfur accumulation.

Example 2

The efficacy of Na Y zeolite for adsorbing sulfolane out of aromatics extraction raffinate was confirmed by passing a raffinate stream containing 9 wppm sulfolane over a bed of LZY-52 1/16" extrudates and determining the sulfolane content of the effluent. Experiments were done at liquid hourly space velocities of 2, 5 and 10 whsv 100° F. with naphtha in liquid phase for three week periods. Sulfolane concentration never exceeded 0.05 wt ppm as determined by GC analysis of effluent water extract.

Example 3

The space velocity for achieving maximum removal of sulfur from naphtha with massive nickel was determined testing sulfur removal at two space velocities, i.e., 5 and 8 whsv. The massive nickel used was obtained from UCI as T2451 R&S. Temperature was 350° F. and pressure was 250 psig. The feed was normal hexane spiked with 20 ppm thiophene. At 5 whsv the massive nickel removed all detectable sulfur, i.e., below 0.030 ppm sulfur as determined by Houston Atlas Sulfur Analyzer, Model 825 .R&D/856. At 8 whsv the massive nickel removed between about 50% and 75% of the sulfur in the feed and the product was slightly discolored. No discoloration of product was observed at 5 whsv. Thus liquid hourly space velocities whsv over massive nickel should be less than about 5 whsv to achieve maximum sulfur removal.

Example 4

Conventional reformer feed treating systems can reduce sulfur in treated feed to as low as about 50 wppb of sulfur. This example shows that sulfur in feeds to zeolite reformers must be reduced to no more than one wppb to preclude premature catalyst deactivation so conventional feed treating systems are not adequate for zeolite catalysts:

The first stage reactor in a zeolite reformer train operates at a whsv in the range of about 4 to 5. Zeolite reforming catalyst contains typically 0.8 wt % platinum. With a feed containing 50 wppb sulfur, assuming the sulfur is quantitatively captured by the platinum, the average sulfur content of the catalyst will approach 130 ppm is only 600 hours. At 130 wppm sulfur on catalyst, the ratio of sulfur atoms to platinum atoms in the catalyst for a catalyst containing 0.8 wt. % platinum is the one in ten ratio at which catalyst activity and selectivity are seriously impaired. Runlengths of about 10,000 hours are required for commercial viability. Accordingly, sulfur in feed to zeolite reformers must be reduced to below five wppm to achieve economically practically runlengths and this degree of sulfur removal can not be accomplished with conventional reformer feed treatment processes.

Example 5

The degree of purification achieved in accordance with the present invention is unexpectedly better than the level of purification achieved with processes reported heretofore. In fact, residual sulfur in the naphtha after treatment is less than sulfur resolution capability of the analytical procedure for measuring sulfur in hydrocarbons (ASTM-4045 done using a Houston Atlas analyzer) which is currently 20 ppb. Accordingly, to confirm the effectiveness of the process of this invention, naphtha was adulterated with a large dose of sulfur sufficient to quickly poison the catalyst if not removed. The feedstock was treated using the process of this invention and then fed to a zeolite reformer for long enough to verify that the catalyst did not accumulate sulfur and to observe that catalyst deactivation did not accelerate abnormally.

Although the invention has been described with reference to particular means, materials and embodiments, from the foregoing description, one skilled in the art can easily ascertain the essential characteristics of the present invention; and various changes and modifications may be made to the various usages and conditions without departing from the spirit and scope of the invention as described in the claims that follow.

What is claimed is:

1. A process for treating hydrotreated naphtha comprising:

a) passing naphtha over massive nickel catalyst; followed by b) treating said naphtha from step (a) over a metal oxide under conditions effective for removing sulfur from said naphtha to result in substantially purified naphtha;

c) feeding said substantially purified naphtha over a reforming catalyst comprising a large pore zeolite and at least one Group VIII metal.

2. The process of claim 1, wherein said metal oxide is selected from the group of metal oxides having a free energy of formation of sulfide which exceeds the free energy of formation of platinum sulfide.

3. The process of claim 2, wherein said metal oxide is manganous oxide.

4. The process of claim 3, wherein said treating step b) over manganous oxide is performed by passing said naphtha in the gas phase in the presence of hydrogen over said manganous oxide.

5. The process of claim 4, wherein said conditions for treating said naphtha over said manganese oxide comprise a temperature within the range of about 800° F. and 1100° F.; a hydrogen to oil molar ratio between about 1:1 and 6:1; a weight hourly space velocity (whsv) between about 2 and 8, and pressure between about 50 and 300 psig.

6. The process of claim 1, wherein said treating step a) over massive nickel comprises passing said naphtha in the liquid phase at a temperature between about 300° F. and about 350° f., and whsv less than about 5 over said massive nickel.

7. The process of claim 1, wherein said reforming catalyst is monofunctional and non-acidic.

8. The process of claim 1, wherein said large pore zeolite is zeolite L.

9. The process of claim 1, wherein said Group VIII metal is platinum.

10. The process of claim 1, wherein said reforming catalyst is in the form of an aggregate.

11. The process of claim 10, wherein said aggregates comprise an inert metal oxide binder.

12. The process of claim 1 further comprising treating said naphtha over a Na Y molecular sieve.

13. The process of claim 12, wherein said treating of said naphtha over a Na Y molecular sieve comprises passing naphtha in the liquid phase, at about ambient temperature, and at a whsv between 2 and 10, over said Na Y mole sieve prior to said treating over massive nickel and manganous oxide.

14. The process of claim 1 further comprising treating said naphtha over activated alumina,.

15. The process of claim 14, wherein said treating of said naphtha over said alumina comprises passing said naphtha in the liquid phase, at a temperature between 300° F. and 350° F., and a whsv between 2 and 10, over said alumina after said treating over massive nickel and prior to said treating over manganous oxide.

16. The process of claim 1 further comprising treating said naphtha over a molecular sieve water trap.

17. The process of claim 16, wherein said treating said naphtha over said molecular sieve water trap is accomplished in the liquid phase at ambient temperature and at a whsv between 2 and 10, prior to said treating over said massive nickel and said manganous oxide.

18. The process of claim 16, wherein said mole sieve water trap is a 4A molecular sieve.

19. The process of claim 16, wherein said treating said naphtha over a molecular sieve water trap is the first step in said purification process.

20. A process for treating hydrotreated naphtha feedstock which comprises the sequence:

(a) treating naphtha over a water trap;

(b) treating said naphtha over a Na Y mole sieve;

(c) treating said naphtha over massive nickel;

(d) treating said naphtha over alumina;

(e) treating said naphtha over a metal oxide in the presence of hydrogen to result in a purified naphtha stream; and (f) passing said substantially purified naphtha stream through a reforming catalyst at reforming conditions, said reforming catalyst comprising a large pore, non-acidic zeolite and at least one Group VIII metal.

21. The process of claim 20, wherein said metal oxide is manganese oxide.

22. The process of claim 21, wherein said large pore zeolite is zeolite L, and the said at least one Group VIII metal is platinum.

23. The process of claim 22, wherein said reforming catalyst absorbs less than about one mole of sulfur per 10 moles of platinum per 10,000 hours when said treated naphtha is passed through said reforming catalyst at reforming conditions and at a whsv between four and eight.

* * * * *